United States Patent [19]

Mondek et al.

[11] Patent Number: 4,697,556

[45] Date of Patent: Oct. 6, 1987

[54] MARINE PROPULSION DEVICE CRANKSHAFT BEARING ARRANGEMENT

[75] Inventors: Matthew H. Mondek, Wonder Lake; Louis R. Neal, Zion, both of Ill.

[73] Assignee: Outboard Marine Corporation, Waukegan, Ill.

[21] Appl. No.: 799,814

[22] Filed: Nov. 20, 1985

[51] Int. Cl.[4] ..... F02F 7/00

[52] U.S. Cl. ..... 123/195 HC; 123/196 W; 123/195 R

[58] Field of Search ..... 123/195 R, 195 HC, 196 W

[56] References Cited

U.S. PATENT DOCUMENTS

| | | | |
|---|---|---|---|
| 1,844,386 | 2/1932 | Harris et al. | 123/196 W |
| 2,458,051 | 1/1949 | Bosma | 123/196 W |
| 4,372,258 | 2/1983 | Iwai | 123/196 W |
| 4,452,195 | 6/1984 | Matsumoto et al. | 123/195 R |
| 4,570,584 | 2/1986 | Uetsuji et al. | 123/195 HC |

*Primary Examiner*—Craig R. Feinberg

*Attorney, Agent, or Firm*—Michael, Best & Friedrich

[57] ABSTRACT

A marine propulsion device comprising a lower unit including a rotatably mounted propeller, and an internal combustion engine drivingly connected to the propeller, the engine including an engine block, a crankshaft rotatably supported by the engine block and including an end portion projecting from the engine block, a flywheel including a hub, the hub being mounted on the end portion of the crankshaft and having an outer surface, and a bearing located between the engine block and the outer surface of the flywheel hub for facilitating rotation of the flywheel relative to the engine block.

9 Claims, 2 Drawing Figures

MARINE PROPULSION DEVICE CRANKSHAFT BEARING ARRANGEMENT

RELATED APPLICATION

Reference is made to the copending Luksch, et al. application Ser. No. 830,230, entitled "Marine Propulsion Device Including Compressively Secured Flywheel," filed 2/18/86 concurrently herewith, and assigned to the assignee hereof.

BACKGROUND OF THE INVENTION

The invention relates to internal combustion engines for marine propulsion devices, and, more particularly, to crankshaft bearing arrangements for such internal combustion engines.

In the marine art, it is common to attach the flywheel hub to the upper end of the crankshaft at a point above the upper main crankshaft bearing and seal. Therefore, the portion of the crankshaft extending upwardly from the engine block is necessarily as long as the combined lengths of the upper main bearing, the seal, and the flywheel hub.

Also, at a certain rpm which varies depending on engine construction, a flywheel undergoes a phenomenon known as second order reverse whirl, i.e., the flywheel "wobbles" in the direction opposite the direction of flywheel rotation.

Attention is directed to the following U.S. patents:

| | | |
|---|---|---|
| Matsumoto | 4,452,195 | June 5, 1984 |
| Honda | 4,262,552 | April 21, 1981 |
| Katsumata | 4,146,806 | March 27, 1979 |
| Farr | 4,095,922 | June 20, 1978 |
| Carlsson | 3,955,550 | May 11, 1976 |

SUMMARY OF THE INVENTION

The invention provides a marine propulsion device comprising a lower unit including a rotatably mounted propeller, and an internal combustion engine drivingly connected to the propeller, the engine including an engine block, a crankshaft rotatably supported by the engine block and including an end portion projecting from the engine block, a flywheel including a hub, the hub being mounted on the end portion of the crankshaft and having an outer surface, and bearing means located between the engine block and the outer surface of the flywheel hub for facilitating rotation of the flywheel relative to the engine block.

The invention also provides an internal combustion engine as described above.

In one embodiment, the engine further includes sealing means located between the engine block and the outer surface of the flywheel hub.

In one embodiment, the crankshaft has a longitudinal axis, the end portion has an outer end, and the sealing means is located, in the direction of the longitudinal axis, between the bearing means and the outer end of the end portion.

In one embodiment, the engine block includes a generally cylindrical inner surface defining an aperture, the end portion of the crankshaft extends through the aperture, and the bearing means and the sealing means are located between the inner surface of the engine block and the outer surface of the flywheel hub.

A principal feature of the invention is the provision of an internal combustion engine comprising bearing and sealing means located between the engine block and the outer surface of the flywheel hub. This construction allows a much more compact engine package than is possible with the typical prior art arrangement. Because the bearing (the upper main bearing) and the seal are located between the engine block and the flywheel hub, the length of the portion of the crankshaft extending upwardly from the engine block need only be as great as the length of the flywheel hub. Furthermore, this construction significantly increases the rpm of second order reverse whirl.

Various other principal features of the invention will become apparent to those skilled in the art upon review of the following detailed description, claims, and drawings.

Figure 1:
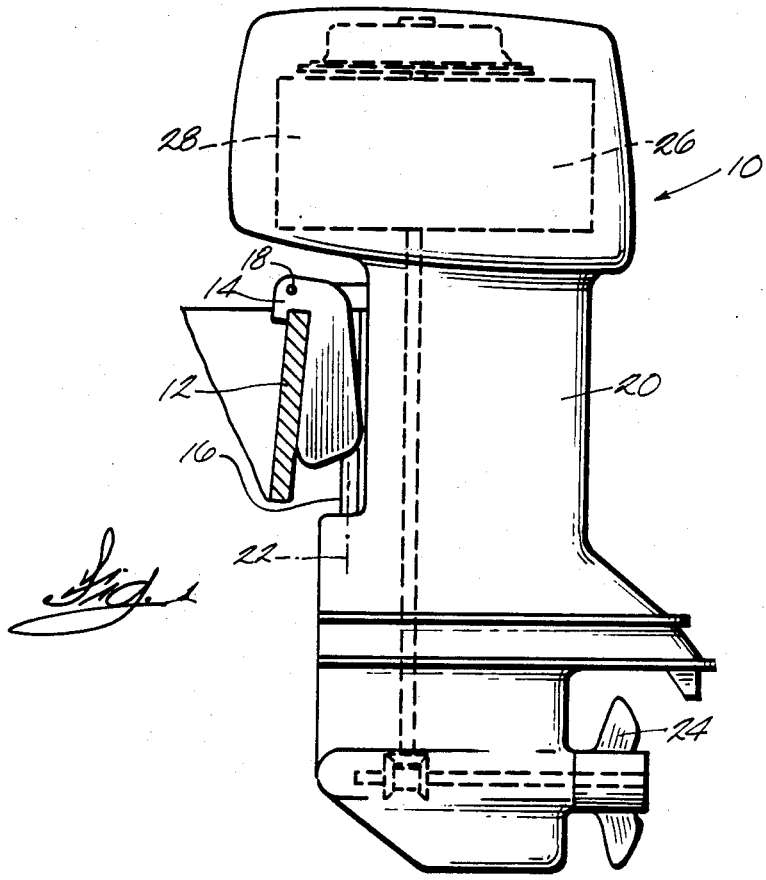
FIG. 1 is a side elevational view of a marine propulsion device which includes an internal combustion engine and which embodies various of the features of the invention.
Figure 2:
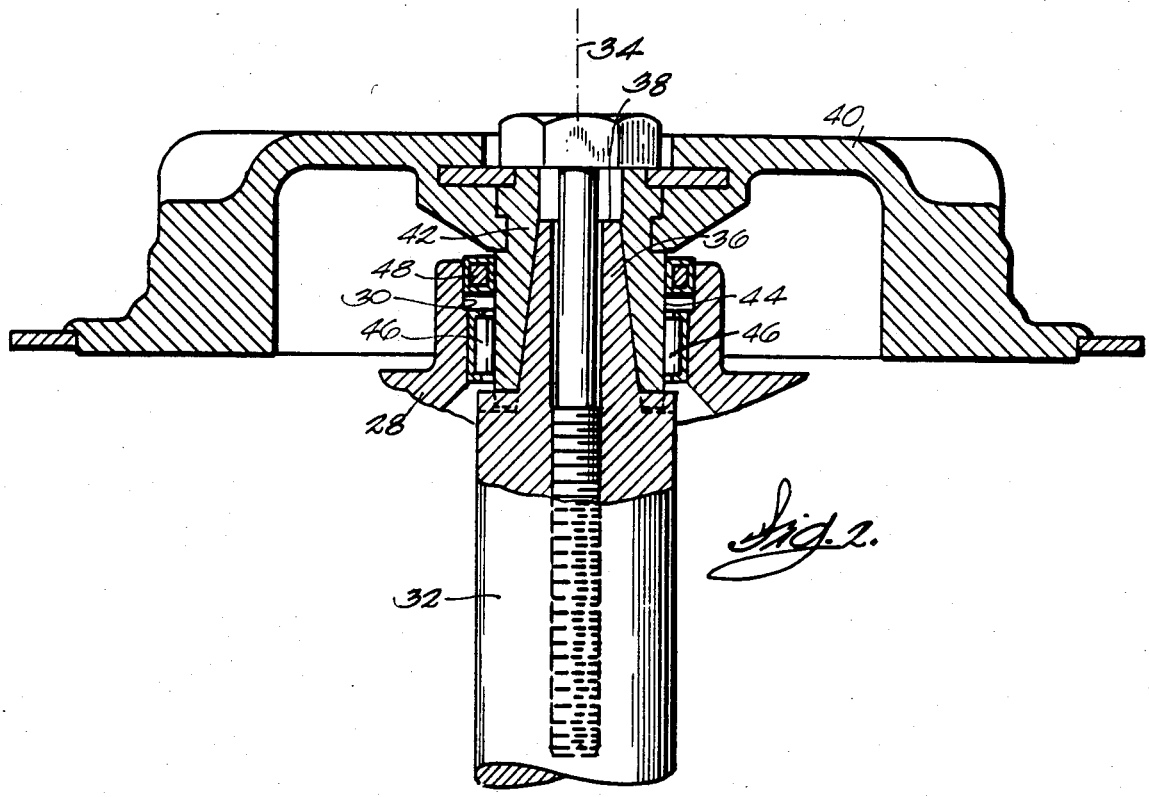
FIG. 2 is a partial, vertical, cross-sectional view of the engine shown in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. As best shown in FIG. 1, the marine propulsion device 10 comprises a mounting assembly fixedly attached to the transom 12 of a boat. While various suitable mounting assemblies can be employed, in the preferred embodiment, the mounting assembly includes a transom bracket 14 fixedly attached to the transom 12, and a swivel bracket 16 mounted on the transom bracket 14 for pivotal movement of the swivel bracket 16 relative to the transom bracket 14 about a generally horizontal tilt axis 18.

The marine propulsion device 10 also comprises a propulsion unit 20 mounted on the swivel bracket 16 for pivotal movement of the propulsion unit 20 relative to the swivel bracket 16 about a generally vertical steering axis 22. The propulsion unit 20 includes a lower unit including a rotatably mounted propeller 24, and an internal combustion engine 26 mounted on the lower unit and drivingly connected to the propeller 24.

The engine 26 includes an engine block 28 which, in the preferred embodiment, includes a generally cylindrical inner surface 30 defining an aperture. The engine 26 also includes a crankshaft 32 which has a longitudinal axis 34 and which is supported by the engine block 28 for rotation about the longitudinal axis 34. The crankshaft 32 has an upper end portion 36 having an upper or outer end 38 and extending through the engine block aperture.

The engine 26 also includes a flywheel 40 including a hub 42. The hub 42 is mounted on the upper end portion 36 of the crankshaft 32 and has a generally cylindrical outer surface 44 facing the inner surface 30 of the engine block aperture.

The engine 26 also includes bearing means 46 (the upper main crankshaft bearing) located between the engine block 28 and the outer surface 44 of the flywheel hub 42 for facilitating rotation of the flywheel 40 relative to the engine block 28. In the preferred embodiment, the bearing means 46 is located between the inner surface 30 of the engine block aperture and the outer surface 44 of the flywheel hub 42. While various suitable bearing means can be used, in the illustrated construction, the bearing means 46 includes a conventional drawn cup roller bearing. In alternative embodiments (not shown), the bearing means 46 can include, for example, ball bearings located between an inner race in the outer surface 44 of the flywheel hub 42 and an outer race in the inner surface 30 of the engine block aperture.

The engine 26 preferably further includes sealing means 48 located between the engine block 28 and the outer surface 44 of the flywheel hub 42. Any suitable sealing means can be employed. In the preferred embodiment, the sealing means 48 is located between the inner surface 30 of the engine block aperture and the outer surface 44 of the flywheel hub 42, and is located, in the direction of the longitudinal axis 34 of the crankshaft 32, between the bearing means 46 and the upper end 38 of the crankshaft end portion 36. In other words, the sealing means 48 is located above the bearing means 46.

This arrangement provides a much smaller engine package than is possible with the typical prior art design, because the upper end portion 36 of the crankshaft 32 is only as long as the flywheel hub 42, instead of as long as the combined lengths of the flywheel hub 42, the sealing means 48, and the bearing means 46. Also, this arrangement increases the rpm of second order reverse whirl, or flywheel "wobble."

Various other features and advantages of the invention are set forth in the following claims.

We claim:

1. An internal combustion engine comprising an engine block having a generally cylindrical inner surface defining an aperture, a crankshaft rotatably supported by said engine block and including a longitudinal axis, and an end portion having an outer end and projecting through said aperture, a flywheel including a hub, said hub having an outer surface and being mounted on said end portion of said crankshaft, and bearing means and sealing means both located radially outwardly of said flywheel hub and between said inner surface of said engine block and said outer surface of said flywheel hub, said sealing means being located, in the direction of said longitudinal axis, between said bearing means and said outer end of said end portion.

2. A marine propulsion device comprising a lower unit including a rotatably mounted propeller, and an internal combustion engine drivingly connected to said propeller, said engine including an engine block, a crankshaft rotatably supported by said engine block and including an end portion projecting from said engine block, a flywheel including a hub, said hub being mounted on said end portion of said crankshaft and having an outer surface, and bearing means located radially outwardly of said flywheel hub and between said engine block and said outer surface of said flywheel hub for facilitating rotation of said flywheel relative to said engine block.

3. A marine propulsion device as set forth in claim 2 wherein said engine further includes sealing means located between said engine block and said outer surface of said flywheel hub.

4. A marine propulsion device as set forth in claim 3 wherein said engine block includes a generally cylindrical inner surface defining an aperture, wherein said end portion of said crankshaft extends through said aperture, and wherein said bearing means and said sealing means are located between said inner surface of said engine block and said outer surface of said flywheel hub.

5. A marine propulsion device as set forth in claim 3 wherein said crankshaft has a longitudinal axis, wherein said end portion has an outer end, and wherein said sealing means is located, in the direction of said longitudinal axis, between said bearing means and said outer end.

6. An internal combustion engine comprising an engine block, a crankshaft rotatably supported by said engine block and including an end portion projecting from said engine block, a flywheel including a hub, said hub being mounted on said end portion of said crankshaft and having an outer surface, and bearing means located radially outwardly of said flywheel hub and between said engine block and said outer surface of said flywheel hub for facilitating rotation of said flywheel relative to said engine block.

7. An engine as set forth in claim 6 and further comprising sealing means located between said engine block and said outer surface of said flywheel hub.

8. An engine as set forth in claim 7 wherein said engine block includes a generally cylindrical inner surface defining an aperture, wherein said end portion of said crankshaft extends through said aperture, and wherein said bearing means and said sealing means are located between said inner surface of said engine block and said outer surface of said flywheel hub.

9. An engine as set forth in claim 7 wherein said crankshaft has a longitudinal axis, wherein said end portion has an outer end, and wherein said sealing means is located, in the direction of said longitudinal axis, between said bearing means and said outer end.

* * * * *